US011028494B2

(12) United States Patent
Batorshin et al.

(10) Patent No.: US 11,028,494 B2
(45) Date of Patent: Jun. 8, 2021

(54) DEVICE FOR CONTROLLED FEEDING AN ELECTROLYTIC CELL FOR PRODUCING ALUMINUM (VARIANTS)

(71) Applicant: United Company RUSAL Engineering and Technology Centre, LLC, Krasnoyarsk (RU)

(72) Inventors: Vladimir Petrovich Batorshin, Krasnoyarsk (RU); Aleksandr Olegovich Gusev, Krasnoyarsk (RU); Vladimir Viktorovich Yurkov, Krasnoyarsk (RU)

(73) Assignee: United Company RUSAL Engineering and Technology Centre LLC, Krasnoyarsk (RU)

( * ) Notice: Subject to any disclaimer, the term of this patent is extended or adjusted under 35 U.S.C. 154(b) by 527 days.

(21) Appl. No.: 15/501,393

(22) PCT Filed: May 5, 2015

(86) PCT No.: PCT/RU2015/000283
§ 371 (c)(1),
(2) Date: Oct. 17, 2017

(87) PCT Pub. No.: WO2016/010453
PCT Pub. Date: Jan. 21, 2016

(65) Prior Publication Data
US 2018/0030605 A1 Feb. 1, 2018

(51) Int. Cl.
*C25C 3/14* (2006.01)

(52) U.S. Cl.
CPC ..... *C25C 3/14* (2013.01)

(58) Field of Classification Search
CPC ..... C25C 3/14; C25C 3/04–24
See application file for complete search history.

(56) References Cited

U.S. PATENT DOCUMENTS 3,006,825 A * 10/1961 Ovrom Sem ..... C25C 3/14 205/392
4,437,964 A * 3/1984 Gerphagnon ..... C25C 3/14 204/245

(Continued)

FOREIGN PATENT DOCUMENTS

CA 2877646 A1 * 1/2014 ..... C25C 3/14
CN 202107780 U 1/2012

(Continued)

OTHER PUBLICATIONS

International Search Report dated Sep. 3, 2015 corresponding to International Application No. PCT/RU2015/000283.

*Primary Examiner* — Ciel P Contreras
(74) *Attorney, Agent, or Firm* — Hogan Lovells US LLP

(57) ABSTRACT

The invention relates to nonferrous metallurgy, in particular to the electrolytic production of aluminum, namely to the devices for feeding electrolytic cells, and can be used to feed alumina, aluminum fluoride, crushed electrolyte to electrolytic cells for producing aluminum. A device for feeding an electrolytic cell for producing aluminum comprises a hopper, a metering chamber with loading windows located around a perimeter of an upper part of the metering chamber above the hopper base, a valve stem with a pneumatic actuator, an upper locking element rigidly fixed to the valve stem at the upper part of the metering chamber, wherein the upper locking element is positioned between upper and lower edges of loading windows, when the stem is in an upper position, and a lower locking element is mounted on an end of the valve stem. According to a first variant of the present invention, the device is characterized in that at least one metering shuttle valve is provided in the upper part of the metering chamber above the upper locking element, and the metering shuttle valve is rigidly fixed to the valve stem so that its upper end in an initial position of the valve stem (Continued)

is located below the upper edge of the loading windows. According to a second variant of the present invention, the device is characterized in that, inside the hopper above the upper locking element, the device comprises at least one circular rib fixed into the upper part of the metering chamber, at least one rib and at least one baffle plate are fixed to the hopper walls so that the material can pass through gaps between plate ends and the walls of the hopper and the metering chamber. The invention provides for the better stability of feeding and may improve processing performance of an electrolytic cell.

6 Claims, 8 Drawing Sheets

(56) References Cited

U.S. PATENT DOCUMENTS

| | | | | |
|---|---|---|---|---|
| 4,919,303 | A * | 4/1990 | Boudreault | B01J 8/003 222/1 |
| 5,423,968 | A | 6/1995 | Kissane | |
| 2010/0129287 | A1 * | 5/2010 | Gabriel | B01J 10/005 423/657 |

FOREIGN PATENT DOCUMENTS

| | | | |
|---|---|---|---|
| RU | 2006120245 | A | 12/2007 |
| WO | 2014011073 | A1 | 1/2014 |

* cited by examiner

DEVICE FOR CONTROLLED FEEDING AN ELECTROLYTIC CELL FOR PRODUCING ALUMINUM (VARIANTS)

The invention relates to nonferrous metallurgy, in particular to the electrolytic production of aluminum, namely to the devices for feeding electrolytic cells, and can be used to feed alumina, aluminum fluoride, crushed electrolyte to electrolytic cells for producing aluminum.

The prior art discloses a device for feeding electrolytic cells (RU 2226572, 2004, C25 C 3/14, published on 2004 Apr. 10). Said device includes a supply hopper, a metering chamber with a flange resting upon hopper bottom, and a valve stem with an actuator. Upper and lower locking metering valves are rigidly fixed on the valve stem. Moreover, the upper metering valve is located above the metering chamber, wherein the upper metering valve has a shape of a hemisphere with its base down, and the lower metering valve has a shape of a cone with its apex downwards. The diameter of the hemisphere is larger and the diameter of the cone is smaller than the diameter of the metering chamber. A housing is connected to the metering chamber by metal studs, which are distributed uniformly along its circumference. The distance between the housing and the upper metering valve at its lowest position within the metering chamber equals to 2-20 valve stem strokes. The upper metering valve agitates the feed near a loading opening.

Disadvantages Of This Device Are As Follows:

1. Probability of lumping and bridging of the loose materials above the upper metering valve due to a limited height of the valve impact on feeding materials.

2. Dependence of density and flow of the materials on their level in the hopper.

These disadvantages impair the continuity of the feed supply and filling of the metering chamber.

The closest analog to the device of the present disclosure, in terms of technical essence and technical effect, is a device for feeding an electrolytic cell for producing aluminum (WO2014/011073, C25 C 3/14, published on 2014 Jan. 16). Said device comprises a supply hopper, a metering chamber with a flange resting upon a bottom of the hopper, and a valve stem with an actuator. Upper and lower locking elements are rigidly fixed on the ends of the valve stem in the upper and lower parts of the metering chamber. Loading windows are placed along a perimeter of an upper part of the metering chamber above the hopper bottom. The lower locking element has a tapered metering valve connected to a conical bonnet by a piston; the distance from the base of the tapered metering valve to a lower edge of the metering chamber, when the valve stem is in an upper position, is not less than the distance from the lower surface of the upper locking element to a lower edge of the loading windows. The upper locking element agitates the feed in a limited space near the loading windows.

Disadvantages of this solution are as follows:

1. Probability of lumping and bridging of the loose materials above the upper metering valve due to a limited height of the valve impact on feeding materials.

2. Dependence of density and flow of the materials on the level in the hopper.

These disadvantages impair the continuity of the feed supply and filling of the metering chamber.

The aim of the present invention is providing a device for controlled feeding an electrolytic cell for producing aluminum, wherein said device, as compared with the prior art, provides an uninterrupted supply to and filling of the metering chamber with loose materials.

The technical effect of the present invention is to provide an easy flow of loose materials in the bottom of the hopper near loading windows.

According to a first variant of the invention, there is provided a device for feeding an electrolytic cell for producing aluminum comprising a hopper with a feeding material; a metering chamber with loading windows located around a perimeter of an upper part of the metering chamber above a hopper base; a valve stem with an actuator; an upper locking element rigidly fixed to the valve stem at the upper part of the metering chamber, wherein the upper locking element is positioned between upper and lower edges of the loading windows, when the valve stem is in its upper position; and a lower locking element fixed on the end of the valve stem, characterized in that at least one metering shuttle valve is provided in the upper part of the metering chamber above the upper locking element, and the metering shuttle valve is rigidly fixed to the valve stem so that its upper end in an initial position of the valve stem is located below the upper edge of loading windows.

Particular embodiments of the device according to the first variant of the present invention have the following features:

The metering shuttle valve is configured as a washer, or a hollow truncated cone, or a hollow cylinder, or a sleeve, or a ring.

A perimeter of the metering shuttle valve may have at least one row of openings.

The metering shuttle valve can be connected to the valve stem by radially extending ribs or pins.

These embodiments related to the metering shuttle valve allow for optimizing the device for the agitation efficiency, depending on the properties of the feed material, capacity and design of the hopper.

The distance from the lower edge of the loading window to the bottom end of the upper locking element can be 0.3-1 $D_{MC}$, the distance from the upper end of the upper locking element to the lower end of the metering shuttle valve can be 0.5-3 $D_{MC}$, and the distance from the upper end of the metering shuttle valve to the upper end of the loading windows can be 0.2-3 $D_{MC}$, a metering shuttle valve diameter is 0.4-1.0 $D_{MC}$, where $D_{MC}$ is a metering chamber diameter.

The invention is characterized in that the metering shuttle valve is movable in the upper part of the metering chamber. In contrast to the prior art solutions, the movements of the valve stem make the metering shuttle valve, placed under a layer of alumina, agitate alumina occurring above the locking element and force its supply to the loading windows. As a result, the valve crushes lumps and bridges of the loose materials above the upper locking element and facilitates material flow, and thus ensures the continuity of its supply to and filling of the metering chamber. Such technical solution is particularly useful for improving industrial feeders as a low-cost and easy-to-implement technical solution in a production environment without shutting down the electrolytic cell; for example, by replacing the valve stem and providing it with the metering shuttle valve.

According to a second variant of the invention, there is provided a device for feeding an electrolytic cell for producing aluminum comprising a hopper with a feeding material; a metering chamber with loading windows located around a perimeter of an upper part of the metering chamber above a hopper base; a valve stem with a pneumatic actuator; an upper locking element rigidly fixed to the valve stem at the upper part of the metering chamber, wherein the upper locking element is positioned between upper and lower edges of the loading windows, when the valve stem is in its upper position; and a lower locking element fixed on an end of the valve stem, characterized in that, inside the hopper above the upper locking element, the device comprises at least one circular rib fixed into the upper part of the metering chamber, at least one rib and at least one baffle plate fixed to hopper walls so that the material can pass through gaps between plate ends and the walls of the hopper and the metering chamber.

Particular embodiments of the device according to the second variant of the present invention have the following features:

The ribs fixed to the walls of the hopper and the metering chamber can be perforated, and the baffle plate can be made of a perforated steel sheet, which reduces the overall metal consumption.

The baffle plate can be fixed to the hopper walls by means of ribs and/or pins, which facilitate rigging up and ensure predetermined orientation of the plate and the structure rigidity.

The baffle plate can be configured as a washer, or truncated cone, or truncated pyramid, or plate, or set of plates positioned coaxially to the metering chamber.

These embodiments related to a baffle plate configuration provide a possibility of optimizing the metal consumption and rigidity of the device depending on the specific configuration of the hopper.

The outside upper part of the metering chamber can be provided with at least two radially directed vertical ribs to strengthen the structure at the loading windows.

For better adaptation to the hopper design, the metering chamber can be made of a pipe having a circular, or square, or rectangular, or hexagonal, or triangular cross-section.

The ribs on the walls of the hopper and metering chamber can be secured at an angle, and the angle between the ribs and the metering chamber axis can be between 40-90°. Furthermore, the baffle plate can be mounted on the wall at an angle, and the angle between the baffle and the metering chamber axis may vary from −45° to 90° and from 90° to +45°.

A distance from the upper end of the upper locking element to the above circular rib and the upper edge of the loading windows can be 0.3-3 $D_{MC}$, the distance between the circular ribs can be 1-6 $D_{MC}$, the distance from the upper end of the upper locking element to the lower end of the above baffle plate can be 1-12 $D_{MC}$, the gap between the baffle plate ends and the walls of the hopper and the metering chamber can be 0.5-6 $D_{MC}$, the vertical distance between the plates can be 2-12 $D_{MC}$, the distance between the plate and the rib fixed on the hopper wall and between the ribs can be 1-6 $D_{MC}$ and 2-12 $D_{MC}$, respectively, and the width of the ribs fixed to the walls of the metering chamber and the hopper can be 0.3-3 $D_{MC}$.

The invention is characterized in that, inside the hopper above the upper locking element, the device comprises at least one circular rib fixed into the upper part of the metering chamber, at least one rib and at least one baffle plate fixed to hopper walls so that a material can pass through gaps between plate ends and the walls of the hopper and the metering chamber.

This technical solution limits the gravitational pressure from upper layers to the materials below the baffle plate on bottom of the hopper, and thereby ensures their easy flowing, eliminates compaction, lumping, formation of bridges and immobilized zones, changes in a flow ability when the hopper level of fill fluctuates. The result is not only the continuity, but also the sustainable repeatability of the metering chamber feed. The use of ribs and plates increases the useful hopper volume, eliminates caking by excluding immobilized zones in the hopper bottom part, increases the structure rigidity and decreases metal consumption by reducing the thickness of hopper walls.

The nature of the invention, however, will best be understood when described in connection with the accompanying drawings, in which.

Figure 1:
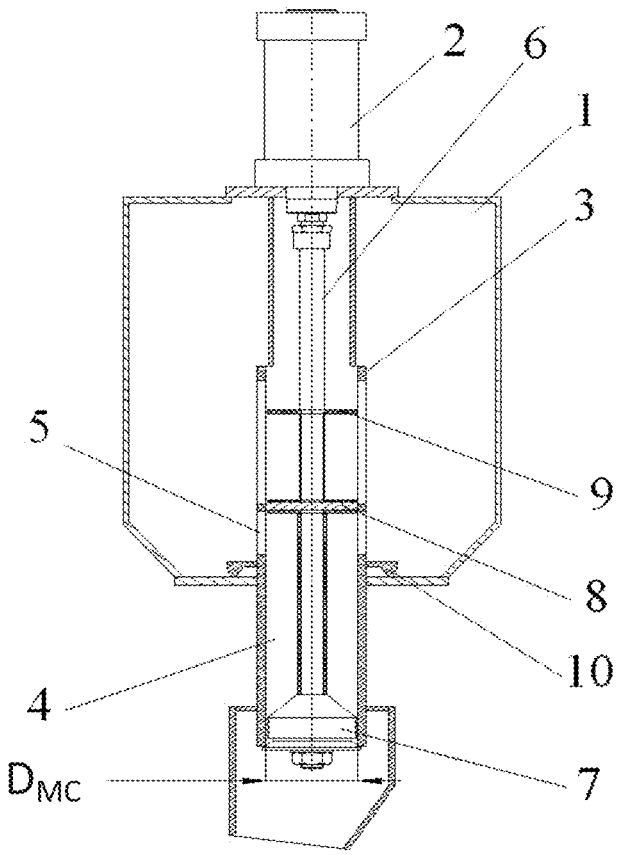
FIGS. 1 and 2 are section views illustrating the devices for feeding an electrolytic cell for producing aluminum according to first and second variants of the present invention respectively.

The feeding device comprises hopper 1, pneumatic cylinder 2, and metering chamber 3. A lower part 4 of metering chamber 3 is located under loading windows 5 under an outlet in the bottom of hopper 1. An upper part of metering chamber 3 as well as loading windows 5 are located in the lower part of hopper 1. Inside the metering chamber is located a valve stem 6 actuated by a pneumatic cylinder 2. To a lower end of valve stem 6 is attached a lower locking element 7; in an upper part of metering chamber, an upper locking element 8 and a metering shuttle valve 9 located below the element are rigidly fixed to the valve stem 6. Metering chamber 3 has a flange 10 that is fixed under loading windows 5 and rests upon a bottom of the hopper 1.

According to the second variant of the invention, unlike the first one, inside hopper 1 above the upper locking element 8 is a circular rib 11 fixed to the outer side of the upper part of metering chamber 3, and a baffle plate 12, wherein a material can pass through gaps between ends of the baffle plate 12 and the walls of hopper 1 and metering chamber 3. Baffle plate 12 is fixed to the wall of hopper 1 by means of vertical ribs 13. However, instead of ribs 13 pins may be used. Above the baffle plate 12 ribs 14 are fixed to the walls of hopper 1. To ensure rigidity, the loading windows 5 of metering chamber 3 have vertical ribs 15 connected to support flange 10.

FIGS. 3-7 are section views illustrating metering shuttle valve 8 respectively shaped as a washer 18 with openings 19 along its perimeter, as a hollow truncated cone 20, as a sleeve 21, as a hollow cylinder 22 mounted on the valve stem 6 by means of vertical ribs 23 and hub 24, and as a ring 25 connected by pins 26 to hub 24.

Figure 2:
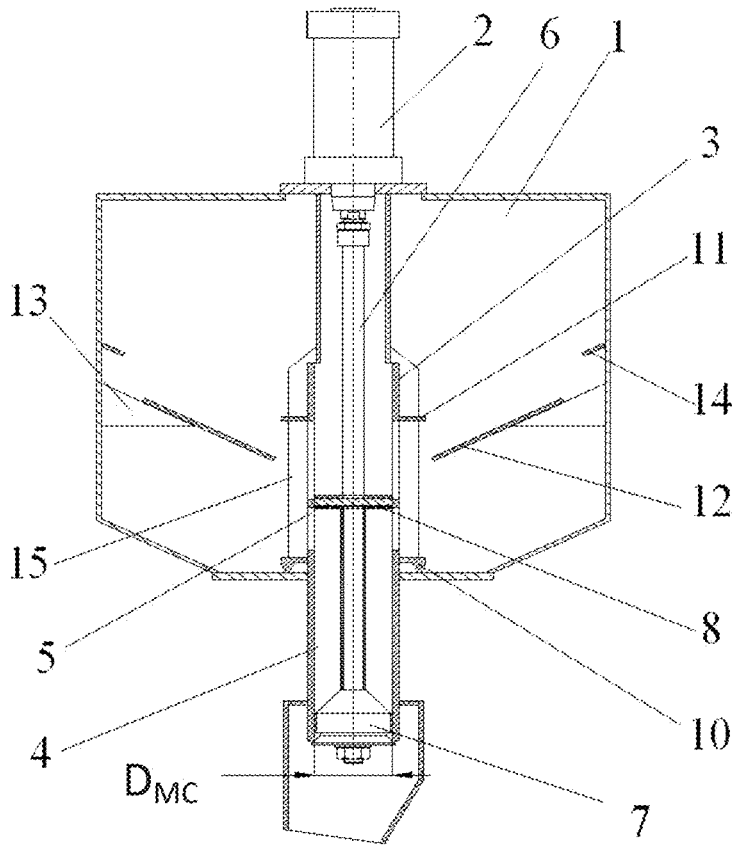
Figure 3:
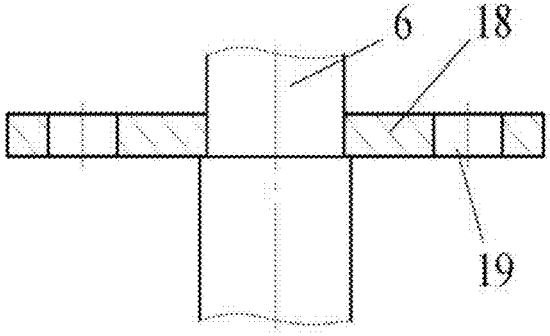
FIGS. 3-7 are section views illustrating embodiments of the metering shuttle valve.
Figure 4:
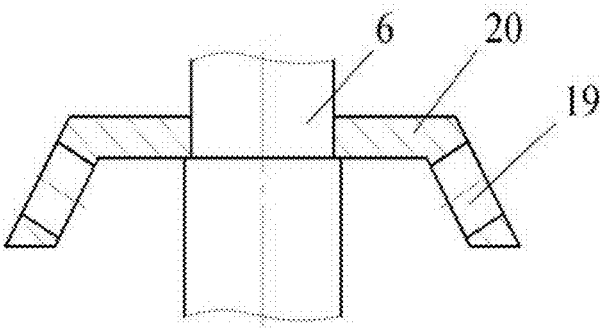
Figure 5:
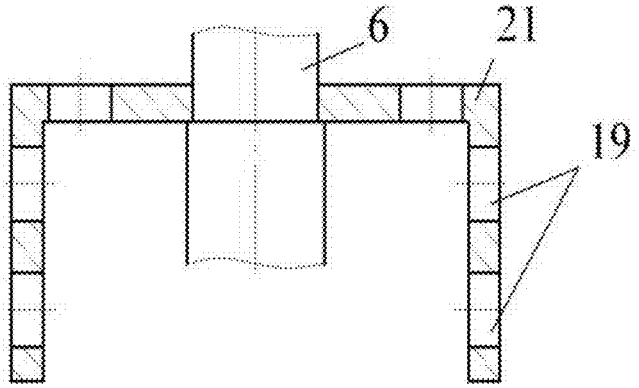
Figure 6:
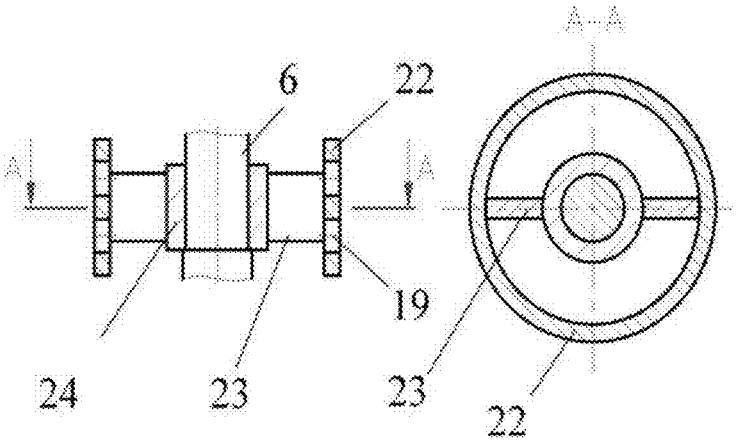
Figure 7:
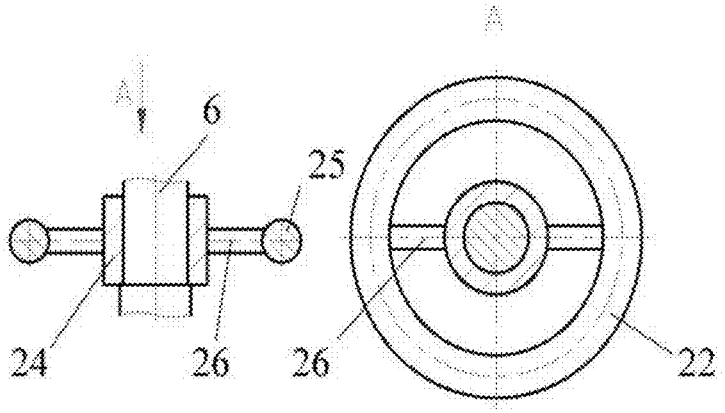
Figure 8:
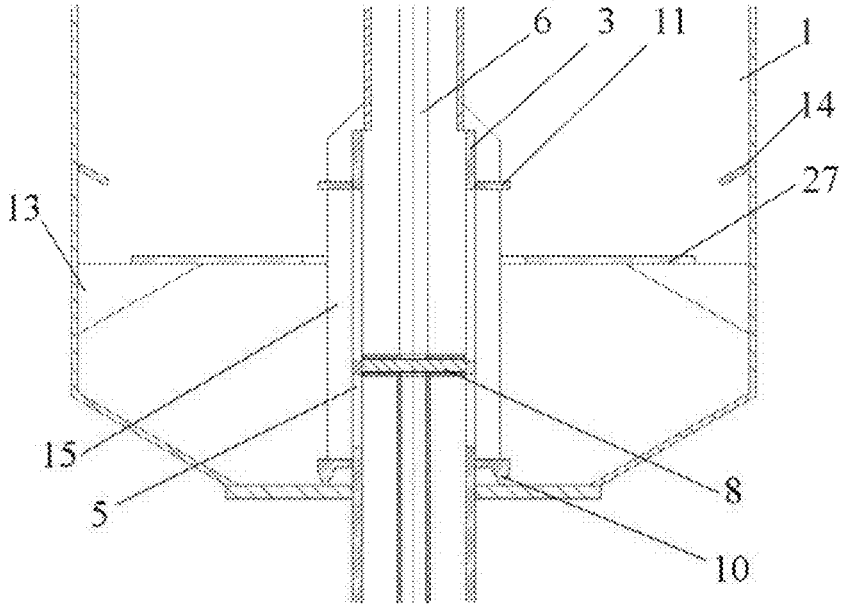
FIGS. 8-10 are section views illustrating embodiments of the baffle plate.
Figure 9:
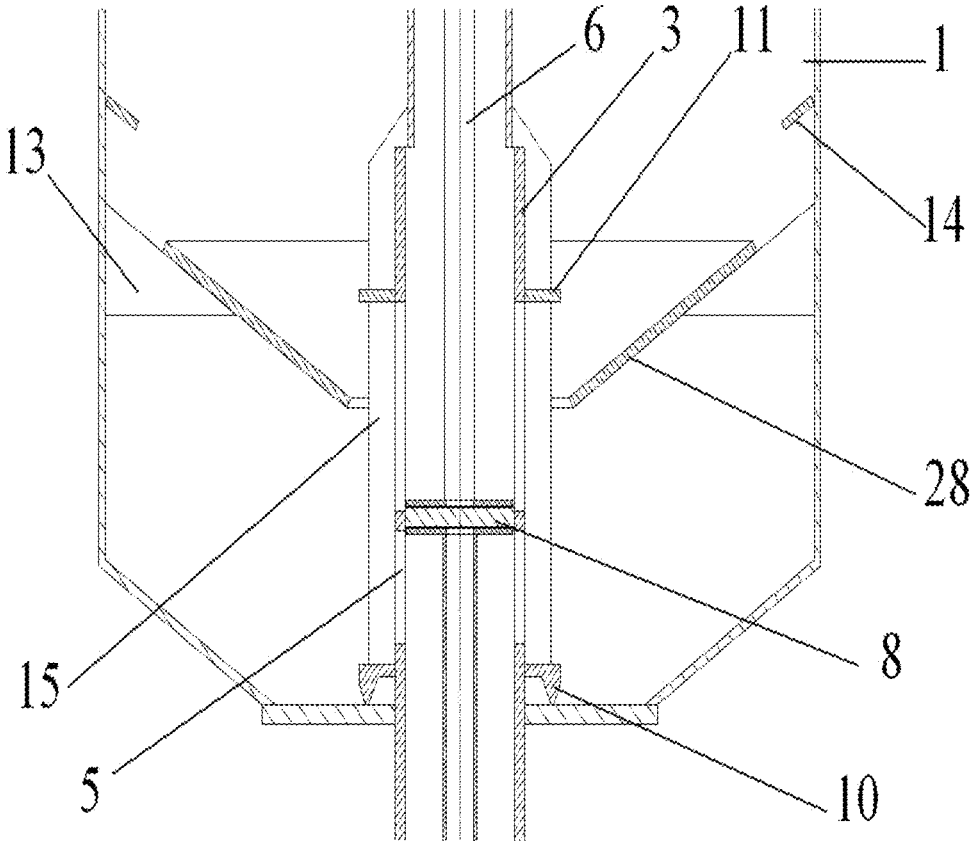
Figure 10:
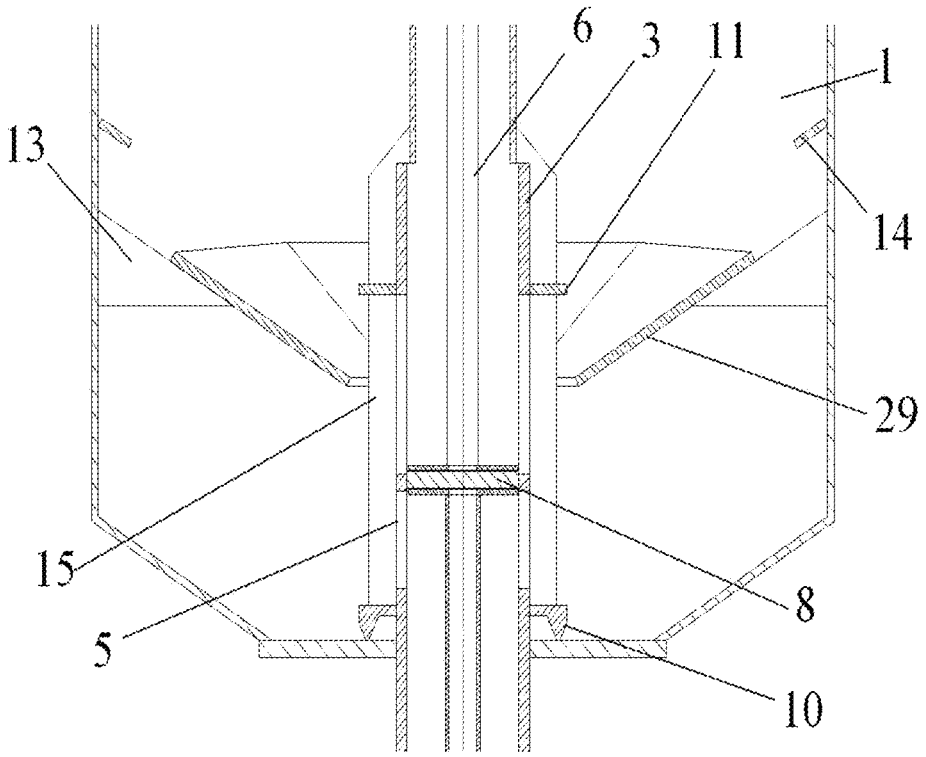

FIGS. 8-10 are section views illustrating a baffle plate shaped respectively as a washer 27, as a truncated cone 28, and as a truncated pyramid 29 coaxial to the metering chamber. FIG. 2 is a section view illustrating a flat-shaped baffle plate 12.

The devices for feeding electrolytic cells function as follows:

The feeding materials continuously fill the space in the zone of loading window 5 in metering chamber 3. In an initial position, valve stem 6 is in its upper position, upper locking element 8 is located between the upper and lower edges of the loading windows 5, and the outlet in the bottom of metering chamber 4 is closed by locking element 7. The material in the bottom of hopper 1 fills the lower part of metering chamber 4 through loading windows 5. To unload metering chamber 4 a control signal goes to pneumatic cylinder 2 that moves downward valve stem 6 with upper and lower locking elements 8 and 7 and metering shuttle valve 9. At this, the passage under loading windows 5 in lower part 4 of metering chamber 3 is blocked by locking element 7 and the loose materials go through the outlet in the bottom of metering chamber 4, and then through a chute into a well in the alumina-electrolyte crust. After emptying metering chamber 4, valve stem 6 makes a backstroke and returns to its initial position. At that, lower locking element 7 blocks the outlet of the metering chamber, upper locking element 8 fully opens a passageway for the material under locking element 8 through loading windows 5 in metering chamber 4.

In the device according to the first variant of the present invention (see FIG. 1), valve stem 6 makes a reciprocal motion from one extreme position to another, and the materials above the upper locking element 8 are impacted by metering shuttle valve 9, which crushes lumps and bridges, and forces the materials to loading windows 5. This ensures an uninterrupted supply of the materials to the loading windows and filling metering chamber 4, and facilitates stabilization of the electrolytic cell feeding.

In the device according to the second variant of the present invention (see FIG. 2), circular ribs 11, baffle plate 12, and ribs 14 prevent the gravitational pressure from the upper layers onto the materials under plate 12, thereby excluding compaction and changes in flowing ability in the entire volume of the lower part of hopper 1, regardless the fluctuations of the fill level in hopper 1, thereby providing a continuous and repetitive filling of metering chamber 4 and a stable feeding of an electrolytic cell. The materials discharged from the lower part of hopper 1 are replenished with the materials from above baffle plate 12, the new materials enter through the gaps between plate 12 and the walls of the hopper 1 and metering chamber 3.

The device according to the present invention provides for the better stability of feeding and may improve processing performance of an electrolytic cell. The efficiency of the technical solutions is confirmed by testing prototypes of the device on operating electrolytic cells.

The invention claimed is:

1. A device for feeding an electrolytic cell for producing aluminum comprising:

a hopper for receiving a feeding material;

a metering chamber with loading windows located around a perimeter of an upper part of the metering chamber above a hopper base;

a stem with a pneumatic actuator;

an upper locking element rigidly fixed to the stem in the upper part of the metering chamber, wherein the upper locking element is positioned between upper and lower edges of the loading windows, when the stem is in an upper position; and a lower locking element fixed on an end of the stem, wherein at least one circular rib is fixed on the upper part of the metering chamber above the upper locking element so that the feeding material can pass through gaps between an end of the at least one circular rib and walls of the hopper; and at least one second rib is fixed to the hopper walls so that the feeding material can pass through gaps between an end of the second rib and the metering chamber, characterized in that the device comprises at least one baffle plate having two ends fixed to the hopper walls so that the feeding material can pass through gaps between the ends of the baffle plate and the at least one circular rib and the at least one second rib and between the ends of the baffle plate and the hopper walls and the upper part of the metering chamber, wherein the at least one circular rib and the at least one second rib are at an angle from between 40° to 90° to the metering chamber.

2. The device according to claim 1, characterized in that the at least one baffle plate fixed to the hopper walls is configured as a truncated cone or truncated pyramid.

3. The device according to claim 1, characterized in that the at least one baffle plate fixed on the hopper walls is fixed on the walls at an angle of −45° to 90° or from 90° to +45°.

4. The device according to claim 1, characterized in that the metering chamber is made of a pipe having a square, rectangular, hexagonal, or triangular cross-section.

5. The device according to claim 1, wherein the at least one baffle plate is fixed to the hopper walls with at least one vertical rib.

6. The device according to claim 1, wherein the metering chamber further comprises at least one vertical rib in the loading windows, the rib being radially directed toward the hopper walls.

* * * * *